United States Patent [19]

Eckmayer et al.

[11] 4,185,011

[45] Jan. 22, 1980

[54] PROCESS FOR THE PRODUCTION OF COLLAGEN FIBERS

[75] Inventors: Zdenek Eckmayer, Heidelberg; Alexander Berg, Hirschberg; Joachim Kühn, Weinheim, all of Fed. Rep. of Germany

[73] Assignee: Firma Carl Freudenberg, Weinstein, Fed. Rep. of Germany

[21] Appl. No.: 951,944

[22] Filed: Oct. 16, 1978

[51] Int. Cl.[2] ..... C07G 7/00

[52] U.S. Cl. ..... 260/123.7; 8/94.1 R; 8/94.15

[58] Field of Search ..... 260/123.7; 8/94.15

[56] References Cited

U.S. PATENT DOCUMENTS

| | | | |
|---|---|---|---|
| 3,435,117 | 3/1969 | Nichols | 260/123.7 |
| 3,579,358 | 5/1971 | Courts | 260/123.7 |
| 3,637,642 | 1/1972 | Fuju | 260/123.7 |
| 4,097,234 | 6/1978 | Sohde et al. | 260/123.7 |

FOREIGN PATENT DOCUMENTS

| | | |
|---|---|---|
| 1619288 | 12/1970 | Fed. Rep. of Germany . |
| 1494740 | 1/1973 | Fed. Rep. of Germany . |

*Primary Examiner*—Walter C. Davison

*Attorney, Agent, or Firm*—Sprung, Felfe, Horn, Lynch & Kramer

[57] ABSTRACT

A process for the preparation of collagen fibers, especially suited for medicinal use, comprising subjecting animal skin, hide or tendons to digestion with a strong alkali until the material has an amide nitrogen content of approximately 0.20 to 0.40 mole per gram, swelling the mass by thorough intermixing with acid, mechanically separating collagen fibers from the mass, de-swelling the collagen fibers with salts or organic solvents, and dehydrating the collagen fibers to approximately 20 to 40 weight % moisture based on the dry weight of the fibers. A plasticizer may be applied to the fibrous mass before dehydration.

8 Claims, No Drawings

PROCESS FOR THE PRODUCTION OF COLLAGEN FIBERS

The invention relates to a process for the preparation of collagen fibers to be used especially in the medical field but also industrially. Skin and/or hide scraps, tendons or the like are disintegrated in an alkaline and acid environment.

It is known to produce collagen products from skin, hide scraps or the like by alkaline or acid digestion or enzymatic disintegration. It is also possible to obtain collagen fibers in this manner. If one does not proceed especially carefully, ageing or restructuring of the collagen fibrils will take place during the processing so that the native character will become lost to a greater or lesser degree. This is unimportant for technical purposes and also in the medical field, e.g. when using the collagen material in remedies superficially applied to the skin, a slight variation is not important. However, for incorporation into highly effective creams it is desirable that the native character of the collagen is maintained to a greater or lesser degree.

When using collagen material or collagen fibers, for instance for contact with wound surfaces, the native character of the collagen has to be preserved as far as possible. In this respect, the hitherto known material needs improvement. The invention is therefore directed to a process for the preparation of native collagen fibers, especially for medical use, having the above-mentioned characteristics.

A process is provided which will disintegrate skin and/or skin wastes, tendons and the like, under alkaline and acid conditions, and separate the unswelled substance after dehydration into fibers. The process is characterized in that the washed and comminuted starting material, with an amide-nitrogen content of up to approximately 0.20 to 0.40 mole per gram, is subjected to the effect of strong alkalis, is subsequently swollen in an acid environment with thorough mixing, and the thus obtained material is separated mechanically, e.g. by a pair of friction rollers, then de-swelled by the addition of aqueous salt solution, tanned if desired, for instance with formaldehyde, dehydrated to about 20 to 40% by weight of moisture based on the dry weight of the fibers, and subsequently converted to fibers, if desired after the addition of a physiologically harmless plasticizer.

The thus obtained collagen fibers are pure native fibers and accordingly possess all characteristics of the native collagen. They are especially suitable for medical purposes and it is possible to displace them in the body metabolically by specific enzymes and thus naturally remove them without residue. It is possible to vary the resorption time of the fibers from days up to several months by suitable implementation of the process, e.g. by the degree of fixation or tanning. The favorable properties of the native collagen will always be maintained thereby and also the high water vapor absorbability, which makes the collagen fibers very suitable also for technical applications. Depending on whether the fibers will subsequently be further processed after the disintegration by means of acid with or without tanning, one will obtain different products. By tanning, one influences the swellability (ability to gel), the mechanical stability and the ability of the fibers to absorb or to resorb fluid.

Processes for the production of collagen fibers from skin materials are known per se. Thus, German DAS No. 14 94 740 describes a process for the production of collagen fibers for the production of leather fiber materials wherein tanned leather serves as raw material. This material is softened, dehydrated and submitted to a pounding treatment. To obtain the actual fibers, the fiber substance treated in this manner is wound tightly around a rotating roller which is provided with a scraping covering to separate out individual fibers. This technology is very simple and the resulting fibers will therefore be coarse and contain large quantities of burls. The fibers can only be used for technical purposes and are obviously unsuitable for medical applications.

According to German DOS No. 16 19 288, collagen fibers are obtained from subcutaneous connective tissue, split leather, machine gluing leather, or the like, by alkaline decomposition, for instance with calcium hydroxide, subsequent liming, tanning and mechanical pulping. The collagen fibers are also very coarse and contain many nubs. Here, too, a medical application cannot be considered. On the other hand, the collagen fibers prepared according to the process of the instant invention are free of nubs and are extremely suitable for medical purposes. When using the process, there are high standards of cleanliness with regard to the raw materials, chemicals and implements.

Skin, skin scraps, tendons or the like are basically suitable as raw material. However, split cowhide from necks prove to be the best raw material. These splits contain very long fibers with the fewest nubs and are available in relatively large amounts. However, in principle one can also use different collagen fibers, whereby one will have to expect somewhat poorer results under certain conditions.

The process according to the invention operates in several stages. The first stage of the processing is the treatment of the comminuted and washed starting material with alkalis. This operation is known per se from leather and gelatin production. It is also used during the preparation of collagen material for processing into sausage casings or the like. The main structure is disintegrated during the alkaline treatment. Proteins not consisting of collagen are removed, for instance proteoglykanes, which would lead to antigenous products. The disintegration can be controlled by the determination of the amide-nitrogen. With the process according to the invention the disintegration preferably takes place up to an amide-nitrogen content of between about 0.20 to 0.40 mole per gram, preferably about 0.30 to 0.40 per gram.

In a second and immediately following step the material is treated with inorganic or organic acids. Accompanying impurities sensitive to acid are thereby removed. After the acid treatment the leather fiber structure is additionally loosened and the substance is thus prepared for the separation of the fibers. The acid treatment is conducted until the material is homogeneously acidified. Then it is washed, i.e. desirably long enough for the pH value of the material to amount to between about 2.5 and 4.0 (depending upon the acid used) through the entire cross-sectional area of the skin or mass.

After the acid treatment the substance will be in swelled condition. Now follows the mechanical separation, which is preferably implemented by means of squeezing or crushing devices, e.g. of pairs of friction rollers whose surfaces may be profiled.

It is desirable that the collagen fibers have an adequate stability. For this purpose, the fiber mass is dehydrated after the mechanical separation by the addition of salts, e.g. sodium chloride, or by variation of the pH value or by the effect of organic solvents. The de-swelling is preferably done by the addition of a concentrated, e.g. 30%, sodium chloride solution. The final amount of the NaCl is to amount to approximately 10% based on the weight of the fibers. Other salts customary in protein chemistry such as, for instance, ammonium sulfate or sodium sulfate, are also suitable. It is possible subsequently to treat the collagen fibers by means of a physiologically suitable plasticizer so that they will obtain a greater smoothness. One uses about 10 to 15 g of plasticizer per kg of fibers.

Now the de-swelled fiber material is tanned. The tanning depends on the optimal fiber condition desired in each case with regard to the specific application.

Basically, there are two possibilities:

1. The de-swelled and partially softened fiber substance is cross-linked in the salt solution by means of formaldehyde. The pH value is adjusted to about 5 to 8, and about 0.5 to 4% formaldehyde based on the fiber content is added. The cross-linking will usually take place within one to five hours and the substance is subsequently freed of salt by washing with clear water. Cross-linking with formaldehyde is a mild and easily controlled method. However, it will lead to cross-linkages which are relatively unstable to acids. A slow and continuous hydrolysis during the separation of formaldehyde also takes place in a neutral environment. To stabilize the cross-linkage effected by formaldehyde, the collagen fibers tanned in this manner are desirably treated with reducing agents, for example sodium borohydride in about 20 to 100-fold based on the molar amount of formaldehyde taken up in cross-linking at a pH value of approximately 6–8, whereby stable cross-linkages will result. The reduction will take place immediately so that the fiber material can be washed with water repeatedly after a reduction of about five minutes in order to remove excess sodium borohydride. The material is then pressed and dehydrated with an organic solvent or with a series of solvents. The selection of a suitable solvent or solvent composition can be determined by suitable preliminary tests if desired. It is advisable to use ethyl alcohol with a physiologically harmless plasticizer for the last bath. The thus prepared material is dried and is directly suitable for further processing or use.

2. The de-swelled and partially softened fiber mass is thoroughly washed free of salt and fat using distilled water at an almost neutral pH value (6.5 to 7.5), then squeezed out and dehydrated with an organic solvent. This will yield especially clean collagen fibers directly suitable for medical purposes, especially also for special medicinal purposes. It is advisable to process the collagen fiber product in a neutral, physiologically suitable environment (pH=about 7.0 to 7.2) with a buffer substance if an especially good compatibility with regard to defensive cell mechanism is desired. The product may be mixed with materials such as medicines and drugs. In this manner one will obtain collagen fibers containing active substances. It is possible to sterilize the collagen fibers in a manner known per se, preferably with gamma rays or by the effect of suitable gases such as ethylene oxide.

The separation of the de-swelled fibers provided in some cases with active substances or the like or containing plasticizers is preferably done mechanically, for instance with a high pressure water jet of at least 5 atmospheres. It is possible to proceess the collagen fibers having different fiber thicknesses according to the methods customary in the textile manufacture. The collagen fibers can be used, for example, as starting material for non-woven textiles, for woven or knit products or for products fashioned in some other way. One can mix the collagen fibers with known natural and/or synthetic fibers.

The following examples illustrate the invention:

EXAMPLE 1

Split material from beef necks is prepared according to a process customary for the production of leather by soaking, liming and splitting off of the grain layer and then washed for half an hour in a hollander. The material is treated for ten days with a 2% calcium hydroxide solution and then again washed with water. The amide nitrogen now amounts to 0.38 milimols per gram.

For deliming, the material is treated for two hours with ammonium sulfate in an amount of 1.5% by weight with regard to the net weight, the ratio of bare hide to liquor amounting to approximately 1:1.5, and then beaten in the drum. The ammonium sulfate is preferably added to the bath in three portions.

After deliming, the material is acidified in a tanning drum with 2% by weight of sulfuric acid based on the weight of the pelt, the pH falling to about 1. The proportion of bare hide to liquor is about 1:1.5 and the treatment lasts for four hours. The material in the drum is washed with running water until the pH value amounts to 3.0. After this treatment the swollen material has a dry weight of 16%.

The splits chemically prepared in this manner are cut into pieces of approximately 30×20 cm and disintegrated by ribbed rollers. The treatment is repeated three times, the pressure preferably being increased with each new calendering process.

5% by weight of sodium chloride is added to the mass of swelled fibers and 50% by weight of water based on the weight of the bare pelt. The mass is left for two hours and then squeezed out.

The collagen fibers prepared in the above-described manner are now tanned with formaldehyde (10% common salt solution, pH adjusted with soda solution to 7.0, three hours processing time, formaldehyde content 3 weight % based on the weight of the bare pelt, proportion of bare pelt to liquor about 1:2.5). After tanning the material is washed free of salt and squeezed out. Dehydration with acetone is thrice repeated. The material is treated with a 5% alcoholic glycerin solution and then squeezed out and dried without solvents. The fibers still contain 35% moisture by weight.

After drying the fibers are separated. For this purpose the material is brought to a carder with an all-steel lining. The average length of the resulting collagen fibers after separation amounts to approximately 2.8 cm. The fibers are physiologically harmless and can be used without additional treatment.

EXAMPLE 2

Raw material and alkaline treatment are the same as in Example 1. The value of the amide-nitrogen will therefore also amount to 0.38 mole per gram. The material is not delimed, however, but after washing is directly acidified in the drum with hydrochloric acid (10% hydrochloric acid based on the net weight, ratio of bare pelt to liquor is 1:2, duration of treatment 5 hours).

The pH value of the material after the acidification is 1.0 and is constant across the entire cross-sectional area. There follows a two hour wash with running water. After washing the pH of the material is 3.0, the dry weight 14%.

The chemically prepared splits are now cut into pieces of approximately 20×30 cm and disintegrated by means of a calender having a pair of friction rollers. The treatment is repeated four times, the pressure being increased with each new calender step.

A saturated ammonium sulfate solution is now added to the swelled fiber mass and the mass is left alone for two hours. After this time the pH value is adjusted with soda solution to 5 and glutaraldehyde (3% based on the weight of the bare pelt) is added to harden the material. After two hours the pH value is adjusted with soda solution to 6.5 and after an additional hour the fixing is finished. The material is washed free of salt, squeezed and then dehydrated as described in Example 1.

The fibers still contain about 35% moisture. After the separation the collagen fibers have an average length of 2.5 cm. The fibers can be used immediately.

EXAMPLE 3

Raw material and alkaline treatment correspond to the conditions of Example 1. After washing, the acid treatment of the material follows directly, without deliming, with acetic acid to a pH value of the material of 3.0. 10% of acetic acid is used with regard to the weight of the bare pelt. The duration of action amounts to two hours and the proportion of bare pelt to liquor is 1:2. Following this, the material is washed in the drum with running water, the pH value increasing to 3.8. The dry weight is 18% after the treatment.

Mechanical processing and de-swelling is then implemented as described in Example 1, the fiber mass being strongly centrifuged, however. After the centrifugal action the material is adjusted with distilled water made slightly alkaline (pH=7.5) with ammonia, washed free of salt and squeezed out. Dehydration with acetone now follows. This operation is thrice repeated. Then the material is again squeezed out and dried free of solvents. The fibers still contain about 30% moisture and are separated by means of a beaker and subsequently by means of a card. The average length of the collagen fibers is about 2.5 cm. Here, too, use of further processing can follow immediately.

Reviewing certain aspects, different sources of collagen may be separately digested with strong alkali under different conditions until each achieves substantially the same amide nitrogen value, and the materials then combined for further processing. The acid swelling which follows results in a glassy appearing product. The acid swelling can be carried out by the addition of strong acids such as phosphoric acid, formic acid, sulfuric acid or hydrochloric acid and continued until the pH throughout the cross-section of the material is about 0.5 to 1.5, or weaker organic acids such as acetic acid, citric acid or lactic acid can be employed and the treatment continued until the pH throughout the cross-section of the material is from about 2.5 to 3.5. While mechanical friction rolls are desirably used for fiber separation, it can be effected with a high pressure water jet of at least 5 atmospheres. Thereafter de-swelling can be effected with about 5 to 20 weight % of salt based on the fiber weight. Then, prior to dehydration, there is supplied to the collagen mass an approximately 5% solution of oleic acid in acetone or of glycerin in ethyl alcohol, whereby upon dehydration the oleic acid or glycerin is left in the collagen as a plasticizer.

It will be appreciated that the instant specification and examples are set forth by way of illustration and not limitation, and that various modifications and changes may be made without departing from the spirit and scope of the present invention.

What is claimed is:

1. A process for the preparation of collagen fibers, especially suited for medicinal use, comprising subjecting animal skin, hide or tendons to digestion with a strong alkali until the material has an amide nitrogen content of approximately 0.20 to 0.40 mole per gram, swelling the mass by thorough intermixing with acid, mechanically separating collagen fibers from the mass, de-swelling the collagen fibers with salts or organic solvents, and dehydrating the collagen fibers to approximately 20 to 40 weight % moisture based on the dry weight of the fibers.

2. The process according to claim 1, wherein the alkaline digestion is continued to an amide nitrogen content of approximately 0.30 to 0.40 mole per gram and the acid treatment is continued until the mass looks glassy, a strong swelling taking place.

3. The process according to claim 1, wherein the acid treatment is carried out by the addition of phosphoric acid, formic acid, sulfuric acid or hydrochloric acid and is continued until the pH throughout the cross-section of the material is from about 0.5 to 1.5.

4. The process according to claim 1, wherein the acid treatment is carried out by the addition of acetic acid, citric acid or lactic acid and is continued until the pH throughout the cross-section of the material is from about 2.5 to 3.5.

5. The process according to claim 1, wherein different sources of starting materials are separately digested with strong alkali until each achieves substantially the same amide nitrogen value, and then the materials are combined for further processing.

6. The process according to claim 1, wherein the mechanical separation of fibers from the de-swelled material is effected by means of a high pressure water jet of at least 5 atmospheres.

7. The process according to claim 1, wherein de-swelling after the mechanical separation of fibers is effected with about 5 to 20 weight % of salt based on the fiber weight.

8. The process according to claim 1, wherein prior to dehydration there is supplied to the collagen mass an approximately 5% solution of oleic acid in acetone or of glycerin in ethyl alcohol, whereby upon dehydration the oleic acid or glycerin is left in the collagen as a plasticizer.

* * * * *